US006408752B1

(12) United States Patent
McEachern et al.

(10) Patent No.: US 6,408,752 B1
(45) Date of Patent: Jun. 25, 2002

(54) MOUNTING PRINTING PLATE CYLINDER TO ROTATABLE DRIVE SHAFT

(75) Inventors: David A. McEachern, St. Paul; Robert A. Heitman, St. Paul Park, both of MN (US)

(73) Assignee: T.W. Wright, Inc., St. Paul, MN (US)

( * ) Notice: Subject to any disclaimer, the term of this patent is extended or adjusted under 35 U.S.C. 154(b) by 0 days.

(21) Appl. No.: 09/480,128

(22) Filed: Jan. 10, 2000

(51) Int. Cl.[7] ..... B41F 13/10
(52) U.S. Cl. ..... 101/375; 101/479; 492/49
(58) Field of Search ..... 101/153, 174, 101/216, 248, 327, 328, 368, 375, 389.1, 479, 486; 492/40, 49

(56) References Cited

U.S. PATENT DOCUMENTS 3,391,636 A * 7/1968 Brigham ..... 101/248
3,818,831 A * 6/1974 Schultz ..... 101/375
5,819,648 A * 10/1998 Megyesi ..... 101/38.1

* cited by examiner

*Primary Examiner*—Eugene Eickholt

(57) ABSTRACT

A printing plate cylinder has a linear bearing press-fitted into its axial bore with the linear bearing having a ball-bearing surface for engaging a cylindrical rotatable drive shaft to permit axial and circumferential adjustments as needed.

4 Claims, 1 Drawing Sheet

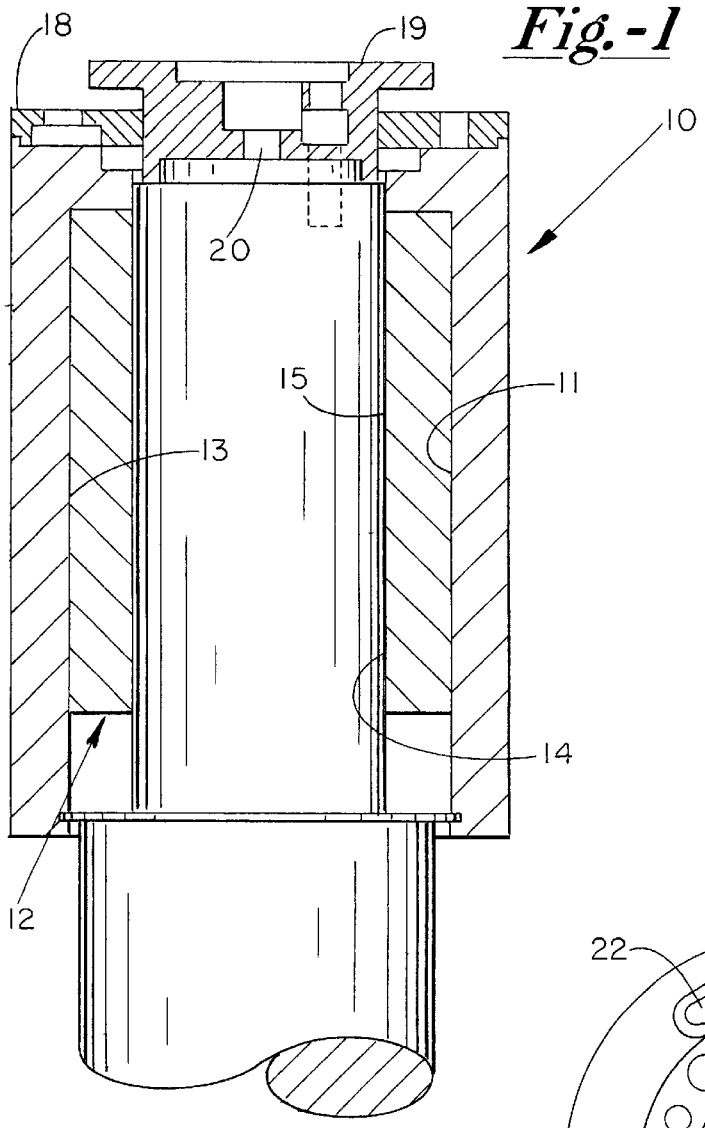
Fig.-1
Fig.-2
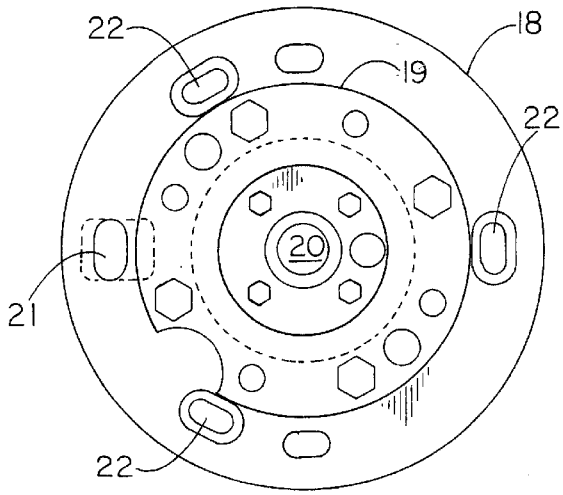

MOUNTING PRINTING PLATE CYLINDER TO ROTATABLE DRIVE SHAFT

FIELD OF THE INVENTION

This invention is directed toward mounting a printing plate cylinder, for example a magnetic cylinder, to a rotatable drive shaft so that it can be adjusted both axially and circumferentially to bring the indicia to be printed into accurate registration.

DESCRIPTION OF THE PRIOR ART

One of the difficulties in using a printing plate cylinder, such as a magnetic cylinder, on printing presses or decorator machines and the like is that the printing or decorator plate has to be changed often. This requires either that the cylinder holding the plate be removed from its drive shaft then the plate removed, the cylinder cleaned, a new plate attached and the cylinder recoupled to the drive shaft or, the cylinder and plate be replaced with another cylinder with attached plate. In either case usually the printed material or indicia on the printing plate has to be aligned with or coordinated with or brought into registry with other printed material or indicia. U.S. Pat. No. 5,819,648 by Megyesi describes some of the problems associated with removal and replacement of printing plate cylinders for a decorator machine which is used to print or place indicia on the exterior of containers such as cans. Oftentimes this material is multicolored and so there has to be exact or very close registration amongst the various printing heads on a multihead printing machine. Other printing machines or presses have similar requirements for accurate registration and location of the printing plate cylinder with it associated attached printing plate. As further mentioned in the '648 patent, some printing presses and decorator machines have straight or right angle cylindrical shafts and others have tapered shafts. There are benefits as well as detriments with each type. The straight right angle shaft generally allows for easier adjustability but repeated replacement causes wear. The tapered shaft generally avoids the wear problem but lacks the adjustability feature. The '648 patent attempts to get the benefits of both types of shafts by using an inner member or sleeve which has a tapered or conical shaped axial bore to engage a tapered rotatable drive shaft and has an outer straight cylindrical surface for engaging a straight line or untapered axial bore of an outer member which is the printing plate cylinder. The outer printing plate cylinder is then adjusted with respect to the inner sleeve member while the latter is mated to or engaged with the tapered shaft. To replace the printing or decorator plate the asembled inner and outer members must be removed from the shaft.

U.S. Pat. No. 5,996,494 by one of the inventors in the instant application describes a first sleeve member having a tapered bore and a straight cylindrical outer surface with the bore engaging the tapered drive shaft in combination with a second sleeve member having a bore for engaging the outer surface of the first sleeve. The second sleeve has an outward flange or ring at one end containing a plurality of guide pins spaced around the ring extending in an axial direction and a set of additional axially extending guide pins at its other end. The printing plate cylinder has openings at one end for engaging the guide pins on the flange and an inward extending ring or flange with openings for engaging the other guide pins. Only the printing plate cylinder is removed to change plates. This arrangement reduces wear on the bore of the printing plate cylinder that normally occurs on repeated replacements but lacks adjustability which has to be provided in some other fashion.

SUMMARY OF THE INVENTION

The surface of the bore or annular surface of a sleeve comprises a bearing surface, preferably a roller bearing surface, which encompasses and engages an untapered rotatable drive shaft. For the purpose of this application, a bearing surface is meant to be a surface making intimate yet adjustable or slidable contact with another surface. In this case it is the annular surface, or portion thereof, of the bore of the sleeve having bearing surface contact with the outer surface of the untapered rotatable drive shaft. The outer surface of the right angle or untapered sleeve is coupled to the straight or untapered bore of a printing plate cylinder. The bearing surface of the sleeve bore in contact with the shaft permits the sleeve and the attached printing plate cylinder to be adjusted both axially and circumferentially with respect to the shaft to bring the indicia or design carried by the printing plate into exact register each time the plate cylinder is removed and replaced.

In the preferred embodiment the sleeve comprises a commercially available linear bearing which is press-fitted into the bore of the printing plate cylinder so essentially it becomes fixedly attached to the printing plate cylinder. The bearing surface allows the printing plate cylinder, with attached plate, to be adjusted axially and circumferentially each time it is replaced.

BRIEF DESCRIPTION OF THE DRAWINGS

FIG. 1 is a partial sectioned vertical plan view of an embodiment of the invention; and FIG. 2 is an end view of the embodiment illustrated in FIG. 1 illustrating the adjustment mechanism.

DESCRIPTION OF THE PREFERRED EMBODIMENTS

A conventional printing plate cylinder 10, such as a magnetic cylinder, has an outer cylindrical surface upon which is conventionally mounted a printing plate, not shown, containing indicia to be printed onto a suitable media. Conventionally the printing plate is held securely in place by the magnetic force of the magnetic cylinder but may have additional clamps. It should be understood that the instant invention can be used and provides the same benefits with nonmagnetic printing cylinders in which the printing plate is held in place by mechanical means. Press-fitted into the axial bore 11 of magnetic cylinder 10 is a cylindrical member 12 having an outer shell 13 so that member 12 is fixedly engaged with cylinder 10. Member 12 has an internal axial bore 14 with the annular or bore surface 15 being a bearing surface preferably in the form of a multiplicity of small roller bearings. Member 12 preferably is a commercially available linear bearing which is available from Linear Rotary Bearings, Inc., 215 Adam Street, P.O. Box 359, Bedford Hills, N.Y. 10507-0359. Details of the features of linear bearings and the construction, function and operation can be found in a catalog No. 94-101 obtainable from the aforementioned source of the bearings. As described and illustrated in the aforementioned catalog, the bearings are constructed with a multitude of miniature balls engaged in recesses on the interior surface of the bearing to provide a ballbearing surface around the bore of the bearing. The linear bearings come in a variety of dimensions as to the outer diameter, length, working bore and other factors which come into the design and use and application of the bearings. For this application, a linear bearing of suitable dimension is chosen so that the ballbearing surface is in contact with a rotatable untapered cylindrical drive shaft of a printing press, not shown. The ball-bearing surface contact allows the assembled printing plate cylinder and linear bearing to be removed and replaced by slipping it off and on the end of the drive shaft with minimum amount of wear. Also, and more importantly, the printing plate cylinder, with its attached printing plate, can be adjusted as necessary both axially and circumferentially to bring the indicia into exact registry as required. Plates 18 and 19 and associated adjustment screws we used to make the axial and circumferential adjustments and to lock the printing plate cylinder onto the rotatable shaft after the printing plate has been brought into exact registry in a conventional and well-known fashion. The aforementioned Megyesi U.S. Pat. No. 5,819,648 describes in some detail the manner in which the two plates along with the adjustment screws are manipulated to provide the necessary adjustments and then lock the cylinder in place. As recited in the aforementioned '648 patent, both the axial and circumferential adjustment need only be to a small degree since the printing plate is initially placed quite close to registration when coupled to the shaft and it is only necessary to make small or incremental adjustments to bring it into more precise registry. The adjustment mechanism is one that is used commercially in a number of printing presses and is well-known in the art and industry. Typically, plate 19 is bolted to the printing press drive shaft through opening 20. Slotted opening 21 is for the purpose of allowing circumferential adjustment utilizing an eccentric or cam shaped screw, not shown, and shouldered screws, not shown, in slotted openings 22 are used to lock the mechanism when in the proper circumferential location. Other openings are for access or for the purpose of accepting tension and/or jack screws which are used to adjust the printing plate cylinder in an axial position and to lock it in place when suitable registry is obtained in a conventional and well-known manner. The adjustments may affect one another to some degree so that each time there is an adjustment in one direction there might have to be a slight correction to the other adjustment so the operator may have to repeatedly change the adjustments until the printing plate is in acceptable registration and then it is locked into place.

We claim:

1. Apparatus for mounting a printing plate onto a rotatable untapered cylindrical printing press drive shaft, comprising:

a printing plate cylinder having an axial bore and an outer surface for mounting a printing plate;

a sleeve comprising a linear bearing having an inner bearing surface for engaging a rotatable untapered cylindrical drive shaft for adjustable coupling said sleeve to the drive shaft, said sleeve having an outer untapered cylindrical surface press-fitted into the axial bore of said printing plate cylinder; and means at one end of said printing plate cylinder for adjustably attaching said cylinder to the drive shaft.

2. The invention as described in claim 1 wherein said sleeve comprises a linear bearing having an outer smooth surface press-fitted into the axial bore of said printing plate cylinder.

3. Apparatus for mounting a printing plate to a rotatable untapered cylindrical drive shaft of a printing press, comprising:

an inner sleeve comprising a linear bearing having an axial bore with a bearing surface for surrounding and contacting an untapered cylindrical rotatable printing press drive shaft;

a printing plate cylinder having an axial bore;

said inner sleeve having an outer surface fixedly engaged with the axial bore of said printing plate cylinder; and means at one end of said printing plate cylinder for adjustably attaching said printing plate cylinder to a rotatable printing press drive shaft.

4. Apparatus for mounting a printing plate to a printing press, comprising:

a rotatable untapered drive shaft attached at one end only to a driving source;

a printing plate cylinder having an axial bore and an outer surface for holding a printing plate;

a linear bearing press-fitted into said printing plate cylinder axial bore;

said linear beating having an axial bore with a ball-bearing surface for surrounding and making adjustable contact with the outer surface of said untapered rotatable drive shaft; and means for adjustably attaching said printing plate cylinder to the distal end of said drive shaft.

* * * * *